United States Patent [19]

Collonia

[11] Patent Number: 4,619,230

[45] Date of Patent: Oct. 28, 1986

[54] DEVICE FOR DISCONNECTING THE FEED OF FUEL TO AN INTERNAL COMBUSTION ENGINE

[75] Inventor: Harald Collonia, Glashütten, Fed. Rep. of Germany

[73] Assignee: VDO Adolf Schindling AG, Frankfurt am Main, Fed. Rep. of Germany

[21] Appl. No.: 472,908

[22] Filed: Mar. 7, 1983

[30] Foreign Application Priority Data

Mar. 18, 1982 [DE] Fed. Rep. of Germany ..... 3209839

[51] Int. Cl.[4] ..... F02D 17/04

[52] U.S. Cl. ..... 123/325; 123/339; 123/198 DB

[58] Field of Search ..... 123/198 DB, 198 F, 332, 123/333, 339, 492, 493, 325, 326, 585, 586, 587

[56] References Cited

U.S. PATENT DOCUMENTS

| | | | |
|---|---|---|---|
| 3,868,933 | 3/1975 | Bigalke et al. | 123/339 |
| 3,906,909 | 9/1975 | Garcea | 123/325 X |
| 4,080,947 | 3/1978 | Iizuka | 123/198 F |
| 4,237,830 | 12/1980 | Stivender | 123/493 |
| 4,305,365 | 12/1981 | Iizuka et al. | 123/325 |
| 4,322,947 | 4/1982 | Wössner et al. | 123/198 DB |
| 4,361,121 | 11/1982 | Clemens et al. | 123/198 DB |
| 4,392,467 | 7/1983 | Miyagi et al. | 123/339 |
| 4,417,553 | 11/1983 | Ohkawa et al. | 123/339 |
| 4,441,471 | 4/1984 | Kratt et al. | 123/339 |

FOREIGN PATENT DOCUMENTS

| | | |
|---|---|---|
| 2025516 | 9/1970 | France . |
| 2069180 | 8/1981 | United Kingdom . |

OTHER PUBLICATIONS

Hartel, Gurcer R., "Neues Gemischbildungssystem für Ottomotoren", ATZ Automobiltechnische Zeitschrift, vol. 83, May, 1981, pp. 219-222.

*Primary Examiner*—Willis R. Wolfe, Jr.
*Attorney, Agent, or Firm*—Martin A. Farber

[57] ABSTRACT

A device for disconnecting the feed of fuel to an internal combustion engine with an injection pump during the coasting of an automotive vehicle comprises a solenoid valve for disconnecting and reconnecting the feed of the fuel. The valve is controlled by the decrease in the speed of the internal combustion engine. In order to adapt the disconnect threshold and the reconnect threshold of the feed of the fuel to the characteristic curve of the internal combustion engine at little expense but nevertheless with a large saving in fuel, the solenoid valve is connected to an outlet line of an idle-speed controller which is provided for the same internal combustion engine. The time response of the controller has at least a differential portion in addition to a proportional portion, but possibly proportional, integral and differential portions. The adaptation of the time response portions to the dynamic behavior of the internal combustion engine is the same as for the control for the idling speed.

6 Claims, 4 Drawing Figures

DEVICE FOR DISCONNECTING THE FEED OF FUEL TO AN INTERNAL COMBUSTION ENGINE

The present invention relates to a device for disconnecting the feed of fuel to an internal combustion engine, particularly one with injection pump, upon the coasting of an automotive vehicle, having a disconnect member which is controlled as a function of the decrease in speed of the internal combustion engine, particularly a solenoid valve, for the disconnecting and reconnecting of the feeding of the fuel.

Such known means disconnect the feed of fuel to an internal combustion engine when an idle-speed contact which is controlled as a function of the gas pedal is actuated when the car is coasting and the speed of the engine is greater than a predetermined threshold. In this way, a saving of fuel is obtained since the internal combustion engine does not have to produce any work when the vehicle is coasting but rather should exert a decelerating moment on the vehicle.

A reconnect threshold is present at a lower speed of rotation than the above-indicated disconnect threshold. Upon a drop in the speed below the reconnect threshold the internal combustion engine is again provided with fuel in order to avoid the engine stalling due to a lack of ignitable mixture upon a further drop in speed below the idling speed. The reconnect threshold is in all cases higher than the idling speed since, as a result of the lag in response of the internal combustion engine, it produces power only some time after the feeding of an ignitable mixture. The desired saving in fuel is greater the lower the reconnect threshold is, i.e. the closer the reconnect speed can be brought to the idling speed.

The difference between the idling speed and the reconnect threshold to be maintained in the known means for coasting switching is less, the more slowly the speed drops upon coasting. In order to bring the reconnect speed in permissible manner as close as possible to the idling speed, the prior art provides a so-called adaptive coasting disconnect which takes the rate of the decrease in speed into consideration. This can be achieved by a differential portion of the time response in a transmission member between the speed transmitter and the control member which connects and disconnects the fuel. This time-function member must be adapted to the characteristic curve of the internal combustion engine in order, on the one hand, to obtain optimal lowering of the reconnect threshold as a function of the rate of decrease in speed but, on the other hand, to make certain that, even in the case of unfavorable tolerances of reconnect speed and idling speed, a margin of safety remains, i.e. the speed will in no case drop below the idling speed. This device is relatively expensive, in particular due to the differential time-function member and its adjustment. Nevertheless, excess fuel is still consumed since the device in any case reconnects the feeding of the fuel at a speed which is at a margin of safety from the idling speed.

In order to save fuel there are also known idle-speed controllers which, when the gas pedal is not depressed, actuate an electromagnetic control member so as to actuate a slide in a control port of a bypass to a throttle valve. This idle-speed controller has the result that a predetermined idling speed which is as low as possible and at which the internal combustion engine still operates smoothly, is maintained regardless of disturbing variables such as the temperatures of the internal combustion engine and the intake air. For optimal control of the internal combustion engine with due consideration of the dynamic behavior, these known idle-speed controllers are constructed as PID controllers with proportional, integral and differential time portions. The portions of the time response must, in this case, be adapted to the dynamic behavior of the internal combustion engine. The idle-speed controller produces a saving of fuel upon idling and therefore, in particular, in city traffic. However, it does not effect a complete disconnect of the feeding of the fuel when the speed of the internal combustion engine drops below a predetermined disconnect speed.

The present invention includes the goal of further improving a device for disconnecting the feed of fuel to an internal combustion engine in such a manner that, while reducing the expense of the disconnect device, the saving in fuel is improved in the manner that the difference between the reconnect speed and the idling speed is minimized by utilizing the intercept behavior of the idle-speed controller. In addition, expensive adjustment work upon adapting the device to the dynamic behavior of the internal combustion engine is to be avoided.

This object is achieved in the manner that the solenoid valve (15) is connected to an outlet (line 14) of an idle-speed controller (1) whose time response has a differential portion.

In accordance with the invention, therefore, the idle-speed controller is in surprisingly simple manner used at the same time for coasting disconnect in the manner that a second outlet of the idle-speed controller is connected to the disconnect member (solenoid valve) which connects or disconnects the feed of fuel, while a first outlet of the idle-speed controller is connected in customary manner to a slide in a control port of the bypass of a throttle valve. By using an idle-speed controller having a differential portion of the time response, the coasting disconnect is at the same time adapted in surprisingly simple manner to the dynamic behavior of the internal combustion engine. It has, thus, been found that both for the coasting disconnect and for the speed regulation, one can start from the same time response of the internal combustion engine as controlled system although the correcting values act at different places.

It is particularly advantageous in the case of the device of the invention, aside from the slight additional expense for the coasting disconnect, if idle control is provided for an automotive vehicle. From the saving of a separate adjustment of the coasting disconnect, no tolerance range or tolerance band of the speed must be complied with between the control range of the coasting disconnect and the control range of the idle speed. The saving of fuel can be optimized thereby.

It is particularly advantageous to use an idle-speed controller (1) which is adapted to the characteristic curve of the internal combustion engine and whose time response has proportional, integral and differential portions (time-function member) and which has an electromagnetic control member (3) which is connected to the outlet line 2) of the idle-speed controller, and displaces a slide (4) in a control port (5) of a bypass (6) of a throttle valve (7).

With the above and other objects and advantages in view, the present invention will become more clearly understood in connection with the detailed description of a preferred embodiment, when considered with the accompanying drawings, of which:

Figure 1:
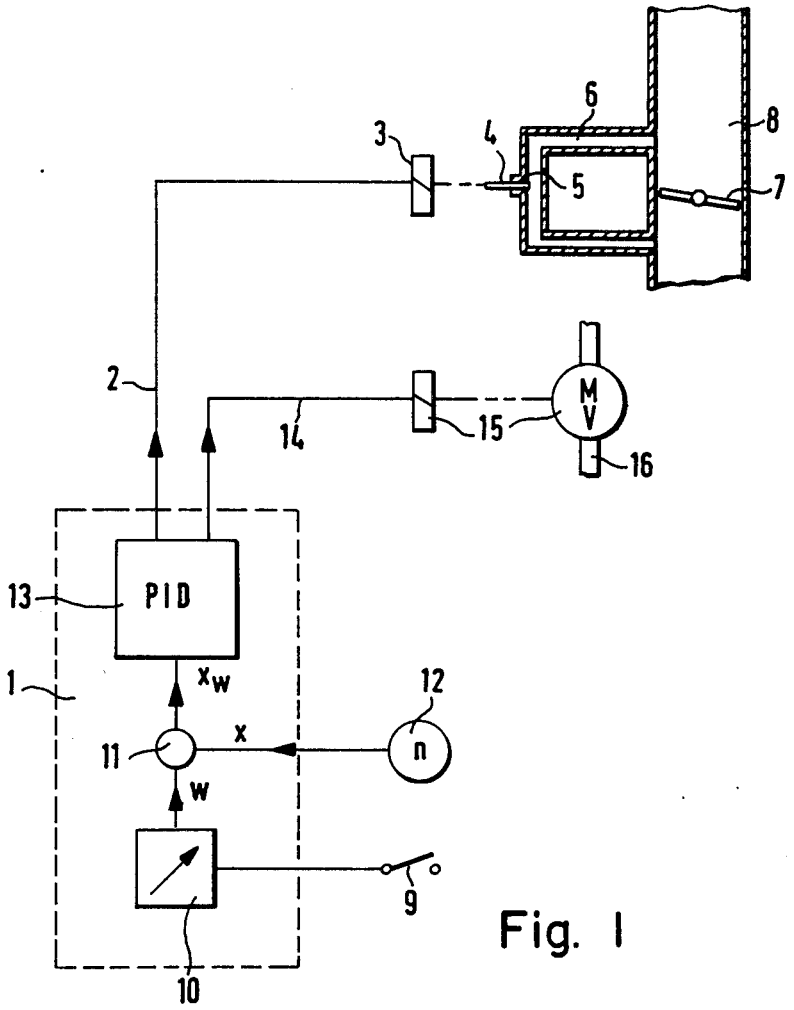
FIG. 1 is a simplified block diagram of the device in accordance with the invention for disconnecting the feed of fuel, in combination with an idle-speed controller.
Figure 2:
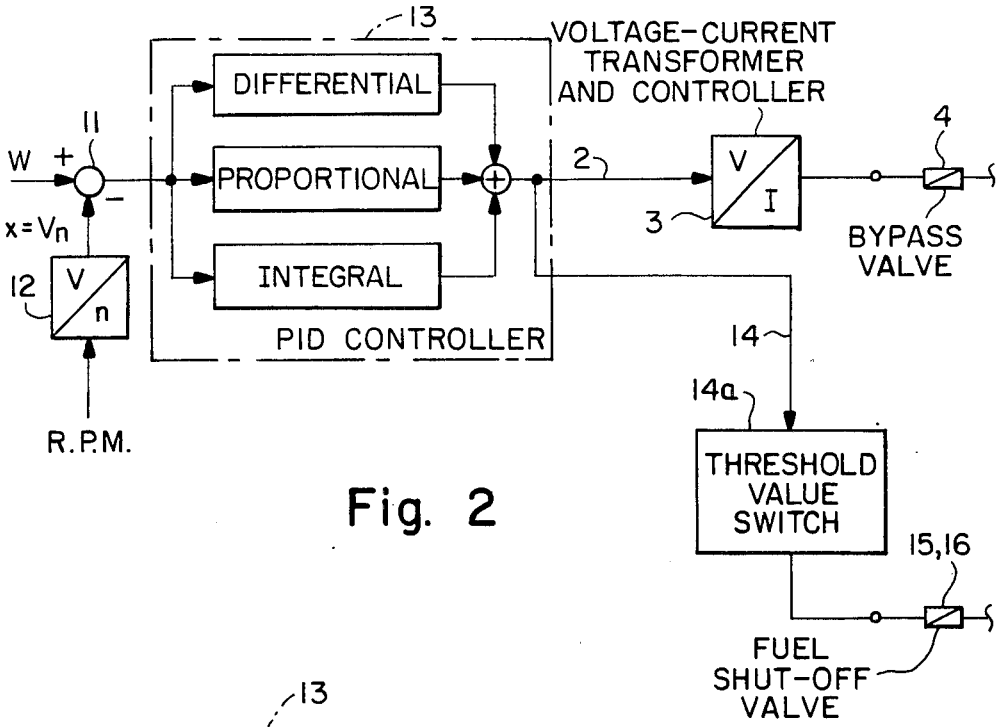
FIG. 2 is detailed block diagram of the circuit of FIG. 1.

In FIGS. 1 and 2 of the drawings, an idle-speed controller 1 has its first outlet connected via a line 2 to an electromagnetic control member 3. The electromagnetic control member 3 transforms an input voltage into a drive current for a continuously variable (analog action) displacement of a slide 4 in a control port 5 of a bypass 6. The bypass communicatingly bridges over a throttle valve 7 in an induction passage 8 of a carburetor of an internal combustion engine. The slide 4 constitutes a bypass valve 4 designated schematically in FIG. 2.

The idle-speed controller 1 has a set-value transmitter 10 for the normal reference value w of the speed, the set-value transmitter being switchable by an idle contact 9. The reference value w is compared at a comparison point 11 with a control variable x emitted by a speed transmitter 12 and the control deviation $x_w$ is formed. The comparison point 11 may be constructed as a subtraction circuit as shown in FIG. 2. The speed transmitter 12 is an rpm to voltage transducer. The idle contact 9 (which may be a switch) is connected to the mixture producer, or the gas pedal, respectively, such that it detects and indicates the idle position. It switches on the reference value x in customary manner as a function of whether the gas pedal is actuated or not.

From the comparison point 11 the signal is sent further to an amplifier with a time-function circuit 13 (PID controller) which has PID behavior, i.e., proportional, integral and differential. The PID controller 13 is adapted in customary per se manner to the dynamic behavior of the internal combustion engine which is to be controlled.

A second outlet of the controller is connected via a line 14 and a threshold value switch 14*a* (FIG. 2) in the line 14 to a solenoid valve 15 which is connected to a fuel line 16 of the vehicle.

The idle-speed controller used in the circuit itself operates in conventional manner. At the same time, the idle-speed controller 1, however, also acts for coasting disconnect by actuation of the solenoid valve 15. The feeding of the fuel is in each case automatically placed into operation by the idle-speed controller 1 when, in customary manner, it shifts the slide 4 in the control port 5 in order to increase the idle speed. This takes place as a result of the differential portion of the PID controller 13 upon a drop in the speed at individual places as soon as the speed drops below a relatively high speed threshold while, upon a slow decrease in the speed the feed of the fuel remains disconnected until the idle speed is reached.

The threshold value switch 14*a* switches the shut off valve 15, 16 in the "on" position when the output voltage of the PID controller 13 exceeds a minimum value. Thus the fuel feed is always turned on when the idle controller is active.

Figure 3:
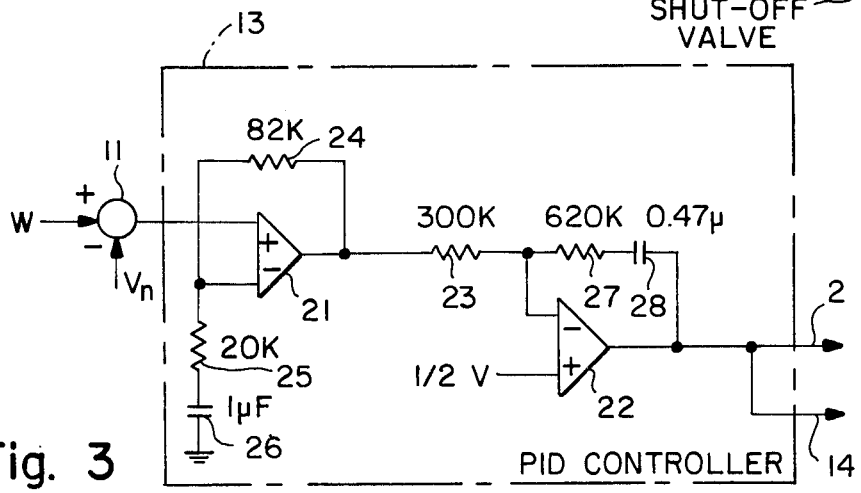
FIG. 3 is a schematic circuit diagram of the PID controller of FIGS. 1 and 2.

FIG. 3 shows an electrical schematic diagram of a preferred embodiment of the PID controller 13. The circuit comprises two operational amplifiers 21 and 22 connected by a resistor 23. The amplifier 21 includes circuitry comprising resistors 24 and 25 and a capacitor 26 which provides the function of a differentiator plus a proportional drive. The amplifier 22 includes circuitry comprising resistor 27 and capacitor 28 which provides the function of an integrator plus a proportional drive. The resistors 23, 25 and 27 introduce the proportional part of the PID function. The foregoing circuit shows parameter values for simulating the characteristics of an engine, it being understood that these values may be altered in accordance with the characteristics of the engine.

By the use of an ordinary idle-speed controller there is thus at the same time obtained an adaptive coasting disconnect, the switching thresholds of which are optimally brought towards those of the idle control since they correspond with the latter, avoiding the safety margin otherwise necessary.

Figure 4:
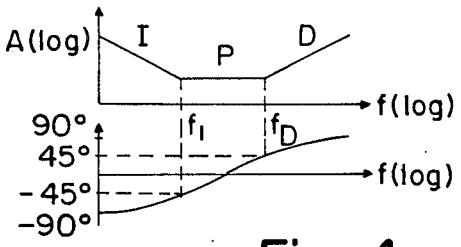
FIG. 4 is a Bode-diagram of a PID controller.

Generally speaking as shown with reference to the Bode diagram in FIG. 4, a PID controller is a PI controller expanded by a parallel connection of a differentiator according to box 13 in FIG. 2. Above the differentiation limit frequency $f_D$ this circuit acts as a differentiator. The phase shift increases up to $+90°$ as can be seen in the Bode diagram in FIG. 4. This phase jump at high frequency can be used to compensate partially the phase lag in the vicinity of the critical frequency ($f_D$). Thus one sets a higher proportional amplification and keeps a higher critical frequency. In this way the transient build-up accelerates. (Titze-Schenk, Halbleiter-Schaltungstechnik ISBM 3-540-08628-5 pages 676-7).

While I have disclosed one embodiment of my invention, this embodiment has been given by example only and not in a limiting sense.

I claim:

1. In a device for disconnecting a feed of fuel to an internal combustion engine, particularly one with an injection pump, upon coasting of an automotive vehicle, having a disconnect member which is controlled as a function of a decrease in speed of the internal combustion engine, particularly a solenoid valve, for disconnecting and reconnecting feeding of the fuel, a valve element for controlling idle speed, and an idle speed controller having a time response with a differential portion, the improvement wherein said valve element has a continuously variable displacement in response to variation of an electric current of said idle-speed controller, there being a threshold switch activated by said electric current; and the disconnect member is connected via said threshold switch to an outlet line of the idle-speed controller such that, upon increasing the idling speed by means of the idle-speed controller, the feed of fuel is also connected automatically each time.

2. In a device for disconnecting a feed of fuel to an internal combustion engine, particularly one with injection pump, upon coasting of an automotive vehicle, having a disconnect member which is controlled as a function of a decrease in speed of the internal combustion engine, particularly a solenoid valve, for disconnecting and reconnecting feeding of the fuel, the improvement comprising an idle-speed controller whose time response has a differential portion;

a valve element for controlling idle speed, said valve element having a continuously variable displacement in response to variation of an electric current of said idle-speed controller;

a threshold switch activated by said electric current; and wherein the solenoid valve is connected via said threshold switch to an outlet line of the idle-speed controller.

3. The device as set forth in claim 2, wherein said valve element is a slide, siad device further comprising a throttle valve assembly incuding a throttle valve and said slide in a control port of a bypass of the throttle valve, and wherein an electromagnetic control member is connected to the outlet of the idle-speed controller for displacing said slide in said control port.

4. The device as set forth in claim 2, wherein said idle-speed controller is adapted to the characteristic curve of the internal combustion engine and said time response including proportional, integral and differential portions.

5. The device as set forth in claim 4, wherein said valve element is a slide, said device further comprising a throttle valve and said slide in a control port of a bypass of the throttle valve, and wherein an electromagnetic control member is connected to the outlet of the idle-speed controller for displacing said slide in said control port.

6. The device as set forth in claim 5, wherein the controller further comprises means for comparing a speed of the engine with a reference speed, and amplifier means connecting with said comparing means for introducing differential and integral functions to provide said characteristic curve of the engine.

* * * * *